US011524883B2

(12) United States Patent
Cacciatore et al.

(10) Patent No.: US 11,524,883 B2
(45) Date of Patent: Dec. 13, 2022

(54) UNITARY DISPENSING NOZZLE FOR CO-INJECTION OF TWO OR MORE LIQUIDS AND METHOD OF USING SAME

(71) Applicant: The Procter & Gamble Company, Cincinnati, OH (US)

(72) Inventors: Justin Thomas Cacciatore, Cincinnati, OH (US); Chong Gu, Beijing (CN); Scott William Capeci, North Bend, OH (US); Ilse Maria Cyrilla D'Haeseleer, Dendermonde (BE); Vincenzo Guida, Woluwe Saint Pierre (BE); Boon Ho Ng, Beijing (CN); Qi Zhang, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/376,605

(22) Filed: Jul. 15, 2021

(65) Prior Publication Data

US 2021/0339996 A1 Nov. 4, 2021

Related U.S. Application Data

(62) Division of application No. 16/436,967, filed on Jun. 11, 2019, now Pat. No. 11,091,359.

(30) Foreign Application Priority Data

Jun. 21, 2018 (WO) ..... PCT/CN2018/092087

(51) Int. Cl.

| | |
|---|---|
| ***B67C 3/02*** | (2006.01) |
| ***B05B 1/14*** | (2006.01) |
| ***B65B 39/00*** | (2006.01) |

(52) U.S. Cl.
CPC ..... *B67C 3/026* (2013.01); *B05B 1/14* (2013.01); *B65B 2039/009* (2013.01)

(58) Field of Classification Search
CPC ..... B67C 3/026; B05B 1/14; B65B 2039/009
See application file for complete search history.

(56) References Cited

U.S. PATENT DOCUMENTS

| | | | | |
|---|---|---|---|---|
| 2,887,133 A | | 5/1959 | Breeback | |
| 2,919,836 A | * | 1/1960 | Limpert | A23G 9/282 222/129 |

(Continued)

FOREIGN PATENT DOCUMENTS

| | | | |
|---|---|---|---|
| CA | 1098058 | A | 3/1981 |
| CN | 88101288 | A | 9/1988 |

(Continued)

OTHER PUBLICATIONS

Extended EP Search Report and Written Opinion for 19181744.4 dated Aug. 19, 2019, 8 pages.

(Continued)

*Primary Examiner* — Timothy L Maust
(74) *Attorney, Agent, or Firm* — Gary J. Foose

(57) ABSTRACT

A unitary dispensing nozzle for co-injecting two or more liquids of different viscosity, solubility and/or miscibility at high filling speed to improve homogeneous mixing of such liquids, while said nozzle is an integral piece free of any movable parts and substantially free of dead space.

12 Claims, 16 Drawing Sheets

(56) References Cited

U.S. PATENT DOCUMENTS

| | | | | | |
|---|---|---|---|---|---|
| 3,114,536 | A * | 12/1963 | Demaison | E04F 21/12 | 222/626 |
| 3,427,999 | A * | 2/1969 | Schultz | A23G 9/285 | 141/105 |
| 3,559,700 | A * | 2/1971 | Erickson | B65B 39/004 | 141/9 |
| 4,022,379 | A | 5/1977 | Ladisch | | |
| 4,218,014 | A | 8/1980 | Tracy | | |
| 4,375,826 | A | 3/1983 | Stohlquist et al. | | |
| 4,388,338 | A | 6/1983 | Wittenborg | | |
| 4,392,588 | A | 7/1983 | Scalera | | |
| 4,512,379 | A | 4/1985 | Hennig | | |
| 4,711,277 | A | 12/1987 | Clish | | |
| 4,753,370 | A | 6/1988 | Rudick | | |
| 4,834,545 | A | 5/1989 | Inoue et al. | | |
| 4,928,854 | A * | 5/1990 | McCann | B67D 1/0044 | 222/145.5 |
| 5,033,651 | A | 7/1991 | Whigham | | |
| 5,129,551 | A | 7/1992 | Gott | | |
| 5,203,474 | A * | 4/1993 | Haynes | B67D 1/005 | 239/419 |
| 5,339,874 | A | 8/1994 | Cragun | | |
| 5,419,348 | A | 5/1995 | Kuta | | |
| 6,076,750 | A | 6/2000 | Mykkaenen et al. | | |
| 6,173,862 | B1 | 1/2001 | Buca | | |
| 6,401,981 | B1 | 6/2002 | Mccann et al. | | |
| 6,402,841 | B1 | 6/2002 | Vesterlund et al. | | |
| 6,415,991 | B1 | 7/2002 | Eriksson | | |
| 6,533,195 | B2 | 3/2003 | Sinders | | |
| 6,837,228 | B2 | 1/2005 | Baasch | | |
| 6,991,004 | B2 | 1/2006 | Kaufhold et al. | | |
| 7,226,631 | B2 | 6/2007 | Thakur et al. | | |
| 7,358,457 | B2 | 4/2008 | Peng | | |
| 7,559,346 | B2 | 7/2009 | Herrick et al. | | |
| 7,918,435 | B2 | 4/2011 | Page | | |
| 8,020,590 | B2 * | 9/2011 | Togni | B65B 39/004 | 141/105 |
| 8,025,792 | B2 | 9/2011 | Delesdernier et al. | | |
| 8,667,996 | B2 * | 3/2014 | Gonnelli | A61J 1/2089 | 604/407 |
| 9,073,023 | B2 | 7/2015 | Bernard | | |
| 9,114,417 | B2 | 8/2015 | Sakamoto | | |
| 9,233,484 | B2 | 1/2016 | Larson | | |
| 9,505,506 | B2 * | 11/2016 | Ammann | B65B 3/36 | |
| 10,507,479 | B2 * | 12/2019 | Bertness | B01F 33/84 | |
| 10,814,291 | B2 | 10/2020 | Chen et al. | | |
| 2005/0058748 | A1 | 3/2005 | Bourguignon | | |
| 2005/0092386 | A1 | 5/2005 | Kaufhold et al. | | |
| 2005/0217270 | A1 | 10/2005 | Sampath et al. | | |
| 2007/0245694 | A1 | 10/2007 | Schmal et al. | | |
| 2008/0245282 | A1 | 10/2008 | Richards | | |
| 2009/0039180 | A1 | 2/2009 | Lukasiewicz | | |
| 2011/0200718 | A1 | 8/2011 | Swertvaegher | | |
| 2013/0105041 | A1 | 5/2013 | Krulitsch et al. | | |
| 2013/0125508 | A1 | 5/2013 | Honda | | |
| 2014/0263760 | A1 | 9/2014 | Hanna | | |
| 2015/0283565 | A1 | 10/2015 | Strand | | |
| 2016/0228891 | A1 | 8/2016 | Rosko | | |
| 2017/0312707 | A1 | 11/2017 | Park | | |
| 2017/0348707 | A1 | 12/2017 | Yattara | | |
| 2018/0036752 | A1 | 2/2018 | Breingan | | |
| 2018/0168185 | A1 * | 6/2018 | Moreau | A23G 9/282 | |
| 2018/0353914 | A1 | 12/2018 | Ng | | |
| 2018/0353915 | A1 | 12/2018 | Chen | | |
| 2018/0354767 | A1 | 12/2018 | Cacciatore et al. | | |
| 2018/0354769 | A1 | 12/2018 | Cacciatore et al. | | |
| 2018/0354770 | A1 | 12/2018 | Cacciatore et al. | | |
| 2018/0355290 | A1 | 12/2018 | Capeci | | |
| 2018/0357759 | A1 | 12/2018 | Zonfrilli | | |
| 2019/0389708 | A1 | 12/2019 | Cacciatore et al. | | |
| 2019/0389709 | A1 | 12/2019 | Cacciatore et al. | | |

FOREIGN PATENT DOCUMENTS

| | | | |
|---|---|---|---|
| CN | 1485142 | A | 3/2004 |
| CN | 103721880 | A | 4/2014 |
| DE | 690574 | C | 4/1940 |
| DE | 9404096 | U1 | 5/1994 |
| EP | 2650253 | A1 | 10/2013 |
| EP | 2361873 | A3 | 5/2015 |
| EP | 2490949 | B1 | 8/2016 |
| GB | 736131 | A | 8/1955 |
| GB | 2256636 | A | 12/1992 |
| GB | 2269761 | B | 12/1995 |
| JP | S5333539 | U | 3/1978 |
| JP | S63236526 | A | 10/1988 |
| JP | 2003530989 | A | 10/2003 |
| JP | H7156998 | A | 6/2007 |
| JP | 3134790 | U | 8/2007 |
| JP | 2007268488 | A | 10/2007 |
| JP | 2007296486 | A | 11/2007 |
| KR | 101207026 | B1 | 11/2012 |
| KR | 20140069844 | A | 6/2014 |
| SU | 1599112 | A1 | 10/1990 |
| WO | 2011049505 | A4 | 7/2011 |
| WO | 2017060453 | A1 | 4/2017 |

OTHER PUBLICATIONS

PCT Search Report and Written Opinion for PCT/CN2018/092087 dated Mar. 21, 2019, 6 pages.
Supplementary PCT Search Report and Written Opinion for PCT/CN2018/092087 dated Mar. 13, 2020, 8 pages.
All Office Actions, U.S. Appl. No. 16/436,967.
All Office Actions, U.S. Appl. No. 16/436,986.

* cited by examiner

UNITARY DISPENSING NOZZLE FOR CO-INJECTION OF TWO OR MORE LIQUIDS AND METHOD OF USING SAME

FIELD OF THE INVENTION

The present invention relates to dispensing nozzles for co-injecting two or more liquids at high filling speed to improve homogeneous mixing of such liquids, as well as method of using such nozzles.

BACKGROUND OF THE INVENTION

Nozzle structures for simultaneously dispensing two or more liquids (e.g., a concentrate and a diluent) into a container are well known. Such nozzles can be referred to as co-injection nozzles.

When the liquids to be dispensed are significantly different in viscosity, solubility, and/or miscibility, it is difficult to ensure homogeneous mixing of such liquids in the container. Further, it is inevitable that when dispensed into the container at relatively high filling speed, the liquids tend to splash, and one or more of the liquids may form hard-to-remove residues on the container wall, which may further exacerbate the issue of in-homogenous mixing. Still further, most of the co-injection nozzles commercially available today are not suitable for high-speed liquid filling, because they contain various moving parts (e.g., O-rings, seal gaskets, bolts, screws, etc.) that may become loose under high pressure, and they also may create dead spaces where liquids can be trapped, which may pose challenges for cleaning and result in poor sanitization.

Therefore, there is a need for a co-injection nozzle that can accommodate high speed liquid filling, with improved homogeneity in the mixing results and reduced formation of residues on the container wall.

SUMMARY OF THE INVENTION

The present invention meets the above-mentioned need by providing a unitary dispensing nozzle for co-injecting two or more liquids, comprising:

(a) a first end;
(b) a second, opposite end;
(c) one or more sidewalls between said first and second ends;
(d) one or more first flow passages for flowing a first fluid through said nozzle, wherein each of said first flow passages is defined by a first inlet and a first outlet, wherein said first inlet(s) is/are located at the first end of said nozzle, and wherein said first outlet(s) is/are located at the second end of said nozzle; and
(e) one or more second flow passages for flowing a second fluid through said nozzle, where said second fluid is different from said first fluid in viscosity, solubility, and/or miscibility, wherein each of said second flow passages is defined by a second inlet and a second outlet, wherein said second inlet(s) is/are located or near on at least one of said sidewalls and wherein said second outlet(s) is/are located at the second end of said nozzle, so that said one or more second flow passages extend through said at least one of the sidewalls and the second end of the nozzle, wherein said second outlet(s) is/are substantially surrounded by said first outlet(s), and wherein said unitary dispensing nozzle is an integral piece free of any movable parts and substantially free of dead space.

Another aspect of the present invention relates to a method of filling a container with liquid compositions, comprising the step of:

(A) providing a container that has an opening, wherein the total volume of said container ranges from 10 ml to 10 liters;
(B) providing a minor liquid feed composition and a major liquid feed composition that is different from said minor liquid feed composition in viscosity, solubility, and/or miscibility;
(C) simultaneously or nearly simultaneously filling said container with the minor liquid feed composition and the major liquid feed composition by using a unitary dispensing nozzle comprising:
  (a) a first end;
  (b) a second, opposite end;
  (c) one or more sidewalls between said first and second ends;
  (d) one or more first flow passages for flowing the major liquid feed composition through said nozzle, wherein each of said first flow passages is defined by a first inlet and a first outlet, wherein said first inlet(s) is/are located at the first end of said nozzle, and wherein said first outlet(s) is/are located at the second end of said nozzle; and
  (e) one or more second flow passages for flowing the minor liquid feed composition through said nozzle, wherein each of said second flow passages is defined by a second inlet and a second outlet, wherein said second inlet(s) is/are located on or near at least one of said sidewalls and wherein said second outlet(s) is/are located at the second end of said nozzle, so that said one or more second flow passages extend through said at least one of the sidewalls and the second end of the nozzle, wherein said second outlet(s) is/are substantially surrounded by said first outlet(s), and wherein said unitary dispensing nozzle is an integral piece free of any movable parts and substantially free of dead space.

These and other aspects of the present invention will become more apparent upon reading the following detailed description of the invention.

Figure 1A:
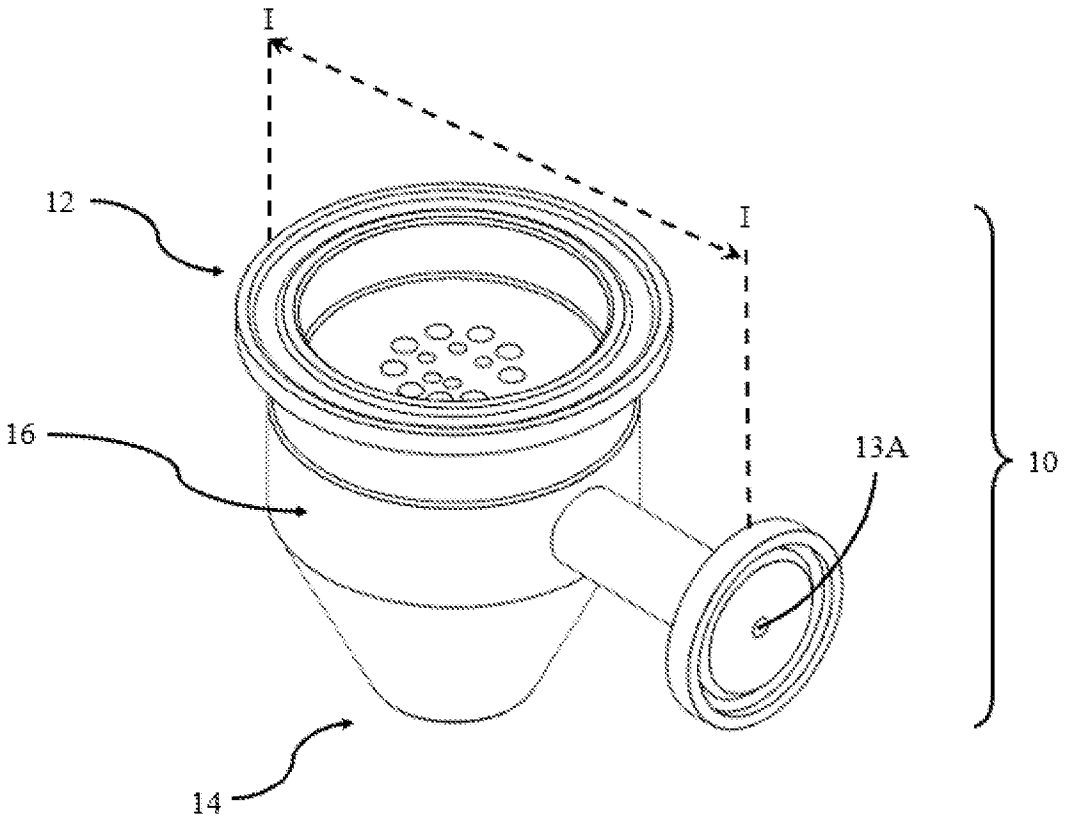
FIG. 1A is a perspective view of a unitary co-injection nozzle, according to one embodiment of the present invention.
Figure 1B:
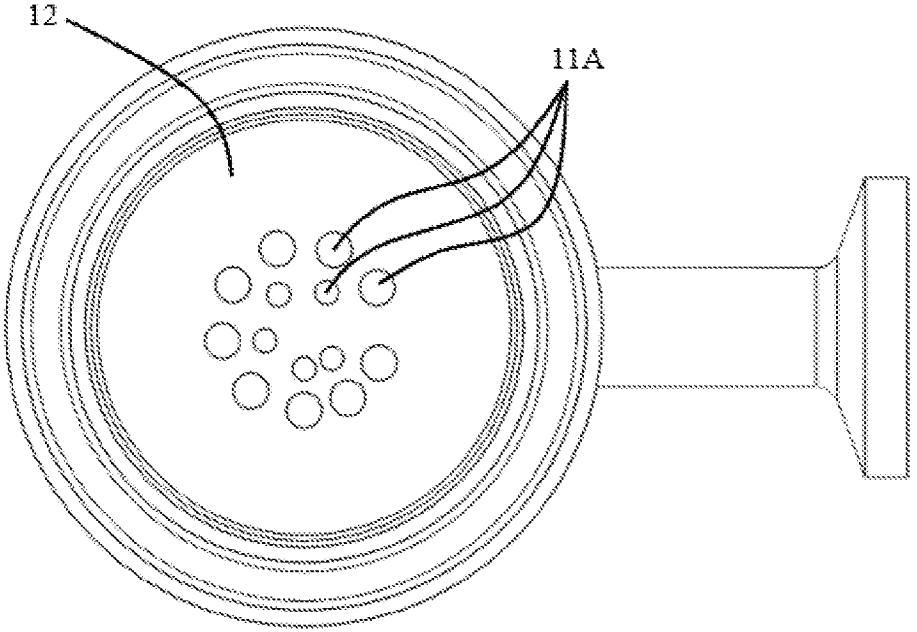
FIG. 1B is the top view of the unitary co-injection nozzle of FIG. 1A.

FIG. IF is a cross-sectional view of the unitary co-injection nozzle of FIG. 1A along a plane that is perpendicular to I-I.

Figure 2A:
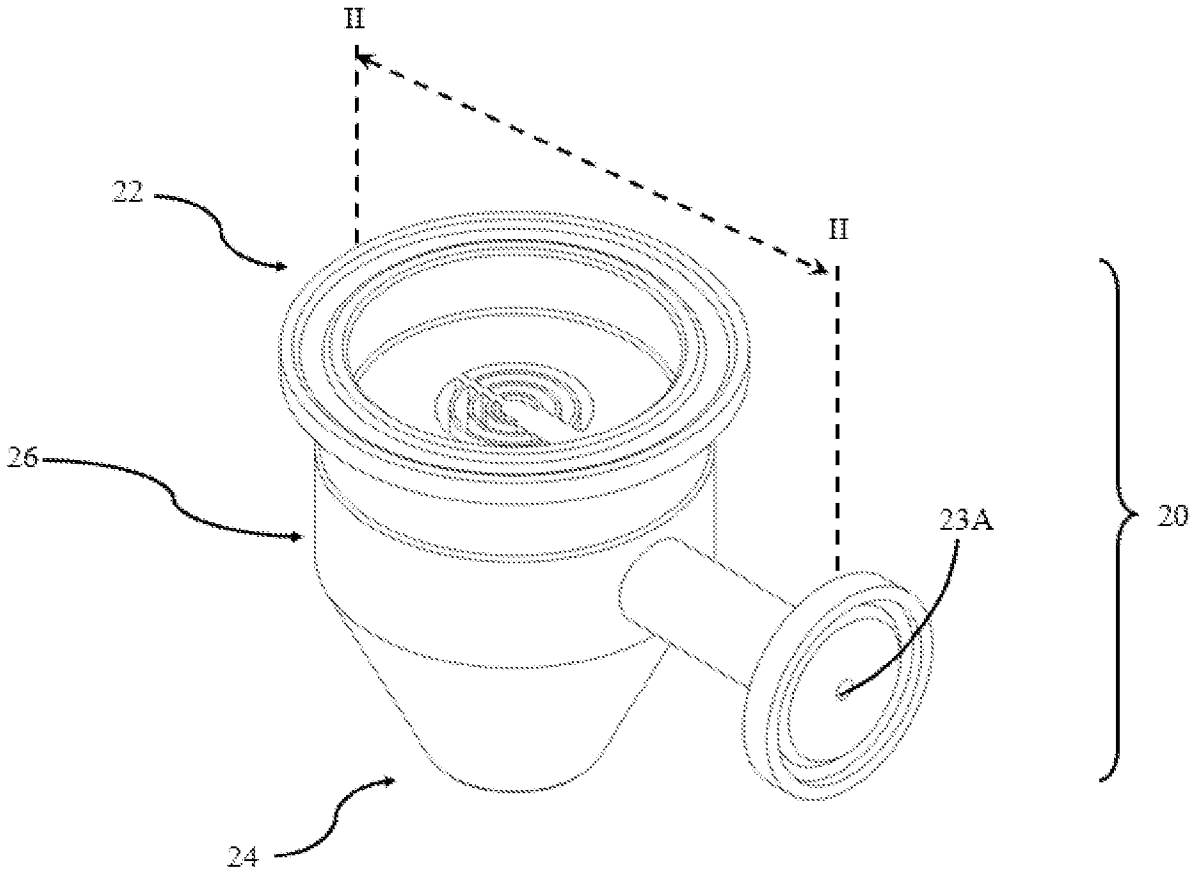

FIG. 2A is a perspective view of a unitary co-injection nozzle, according to another embodiment of the present invention.

Figure 2B:
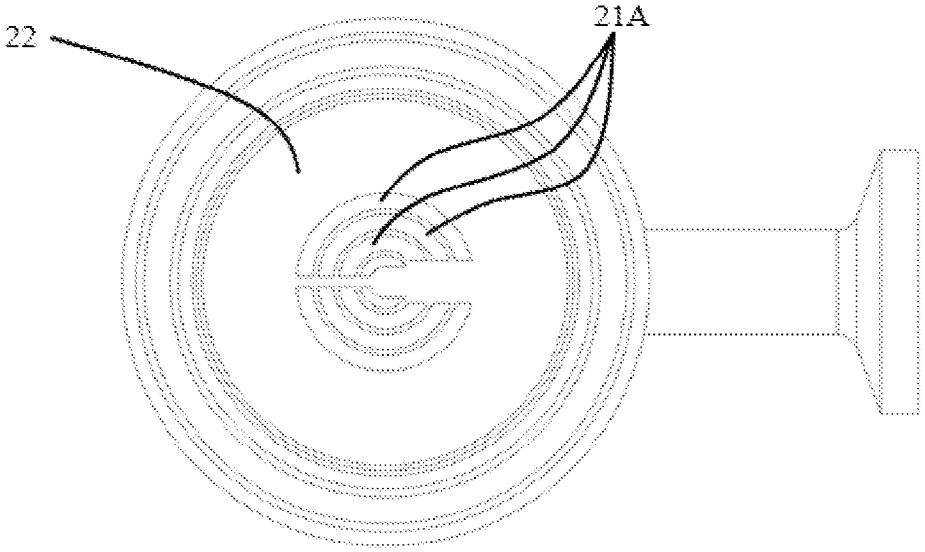

FIG. 2B is the top view of the unitary co-injection nozzle of FIG. 2A.

Figure 2C:
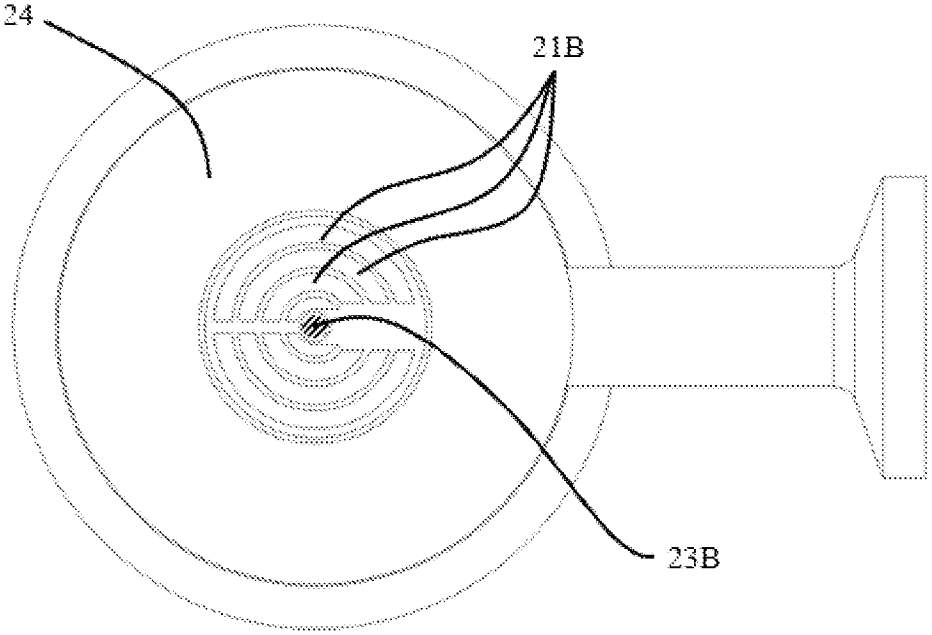

FIG. 2C is the bottom view of the unitary co-injection nozzle of FIG. 2A.

Figure 2D:
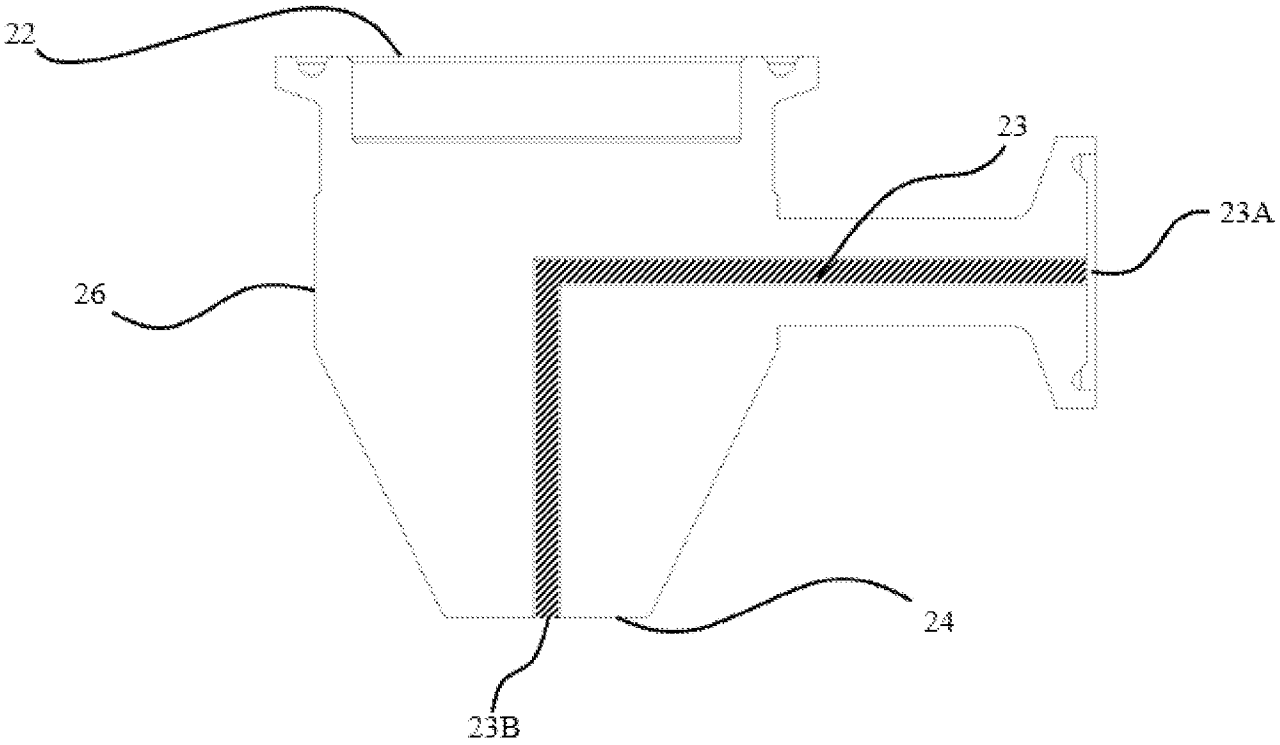

FIG. 2D is a cross-sectional view of the unitary co-injection nozzle of FIG. 2A along plane II-II.

Figure 2E:
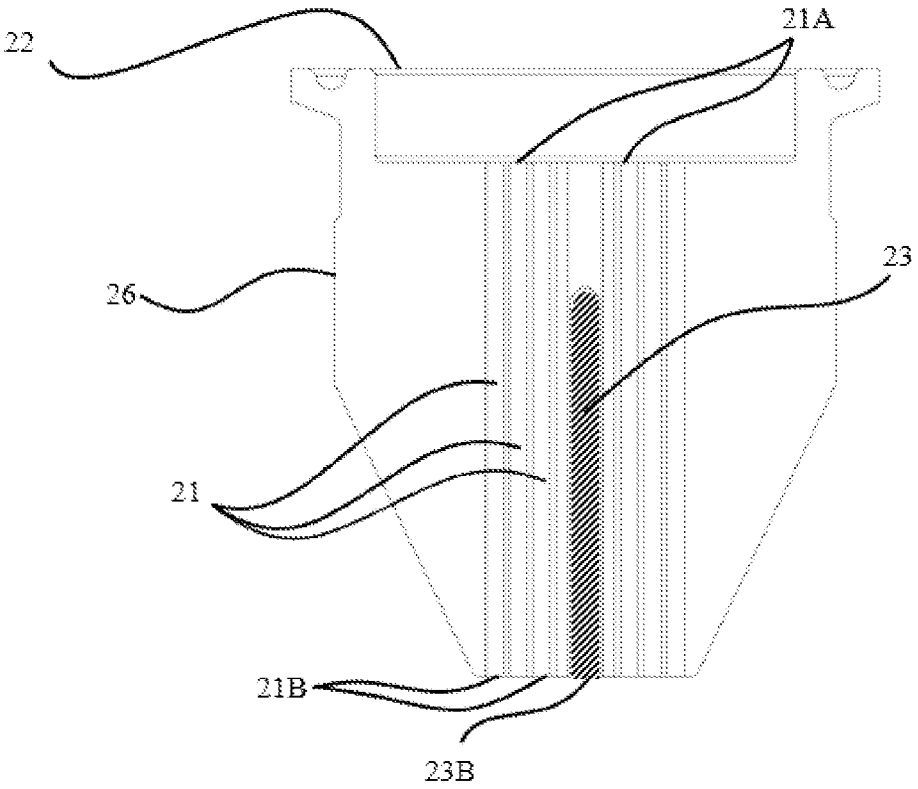

FIG. 2E is a cross-sectional view of the unitary co-injection nozzle of FIG. 1A along a plane that is perpendicular to II-II.

Figure 3A:
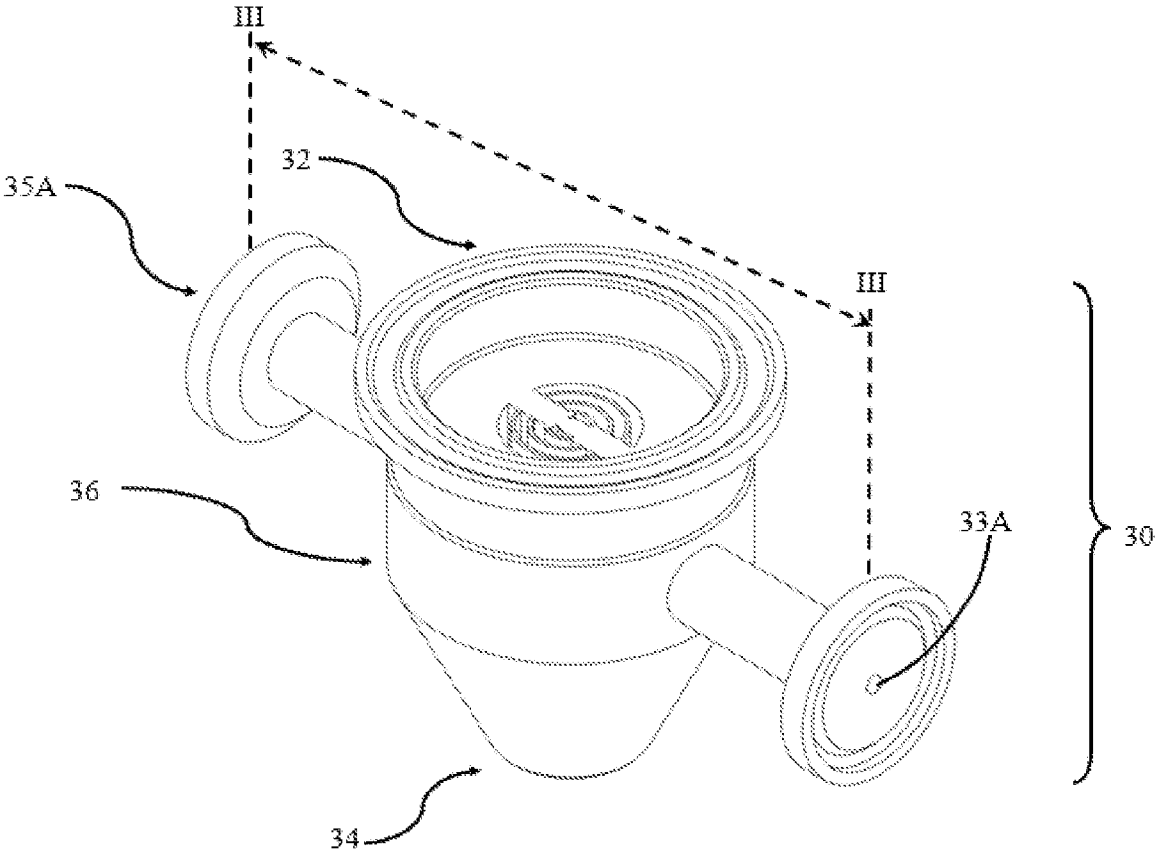

FIG. 3A is a perspective view of a unitary co-injection nozzle, according to yet another embodiment of the present invention.

Figure 3B:
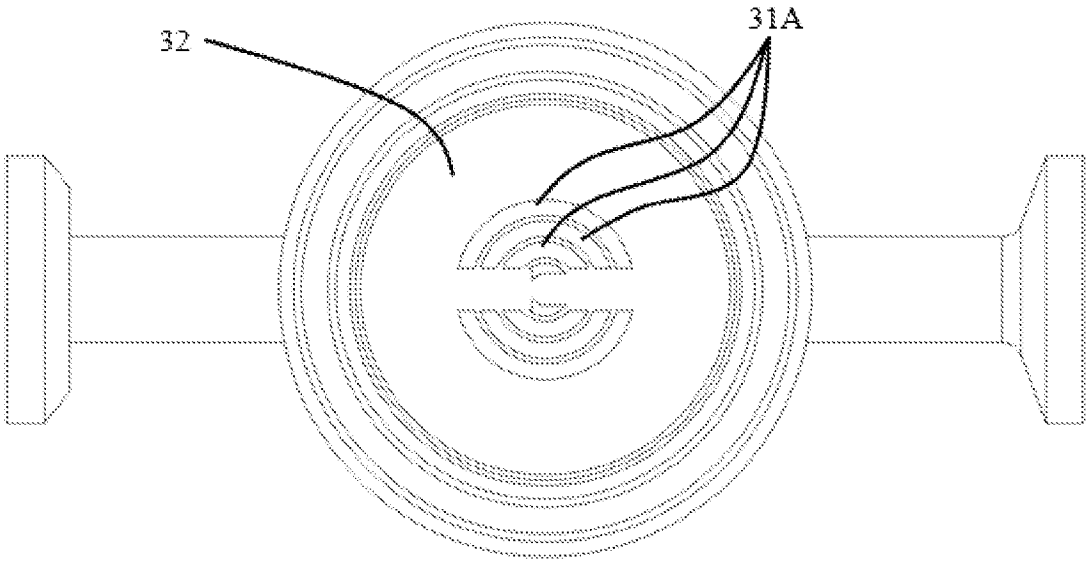

FIG. 3B is the top view of the unitary co-injection nozzle of FIG. 3A.

Figure 3C:
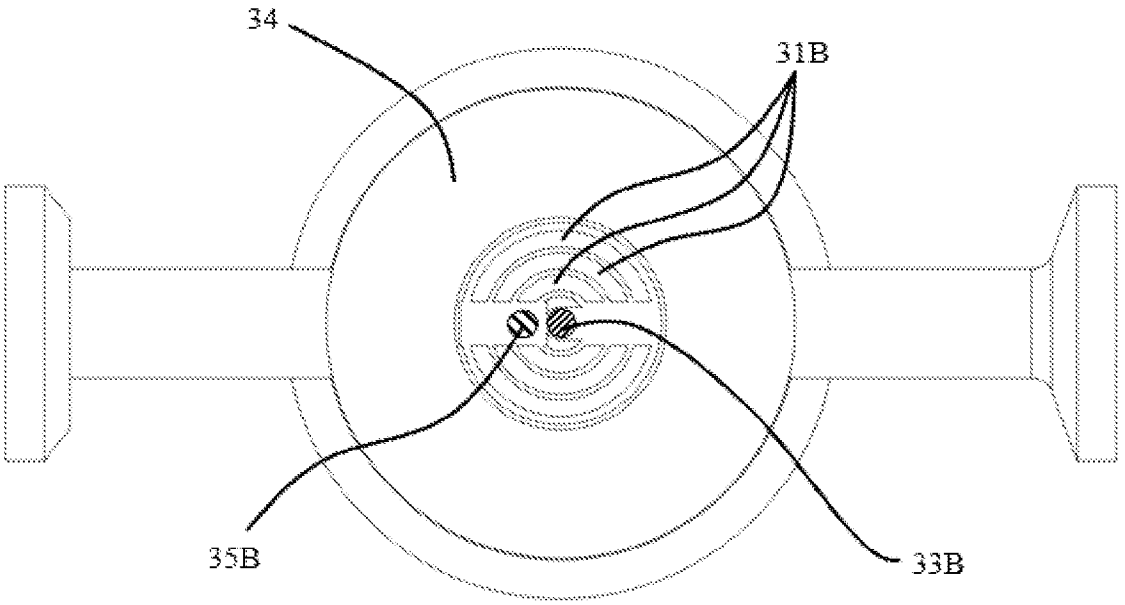

FIG. 3C is the bottom view of the unitary co-injection nozzle of FIG. 3A.

Figure 3D:
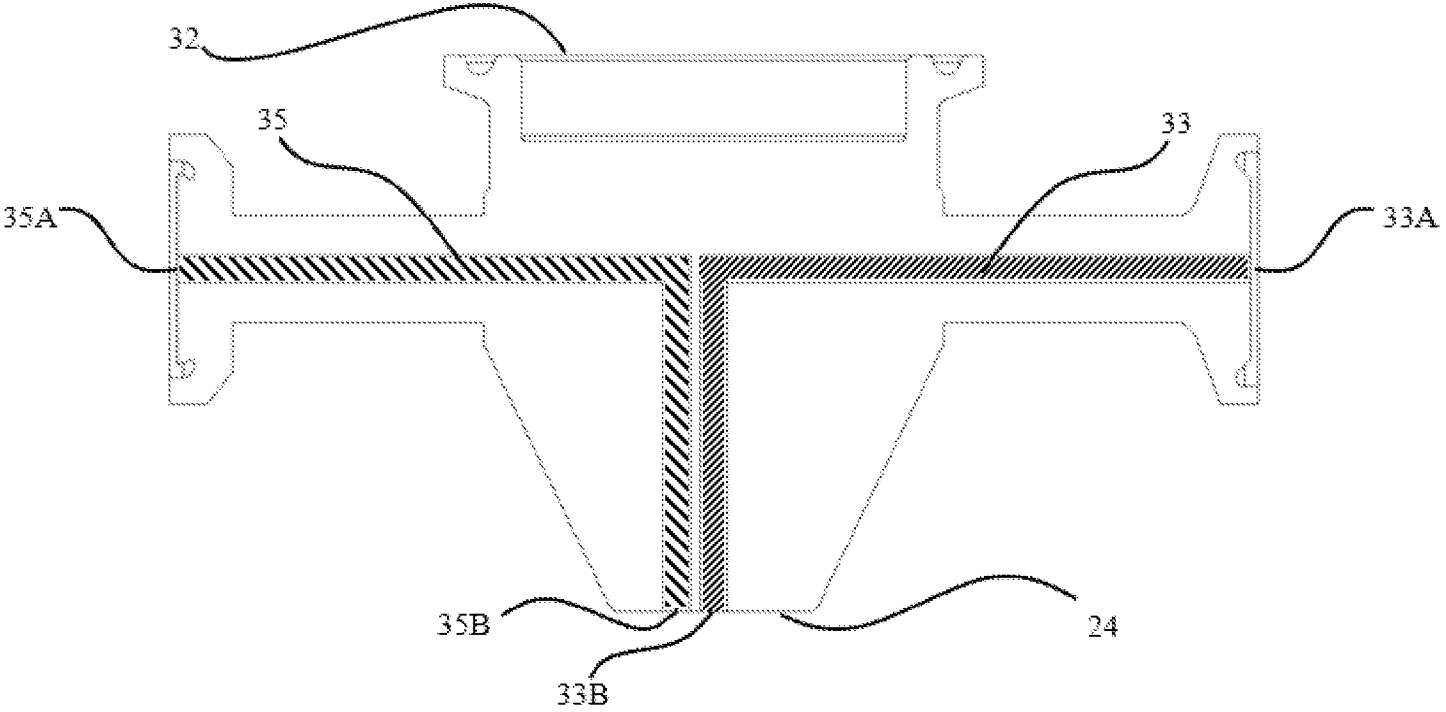

FIG. 3D is a cross-sectional view of the unitary co-injection nozzle of FIG. 3A along plane III-III.

Figure 3E:
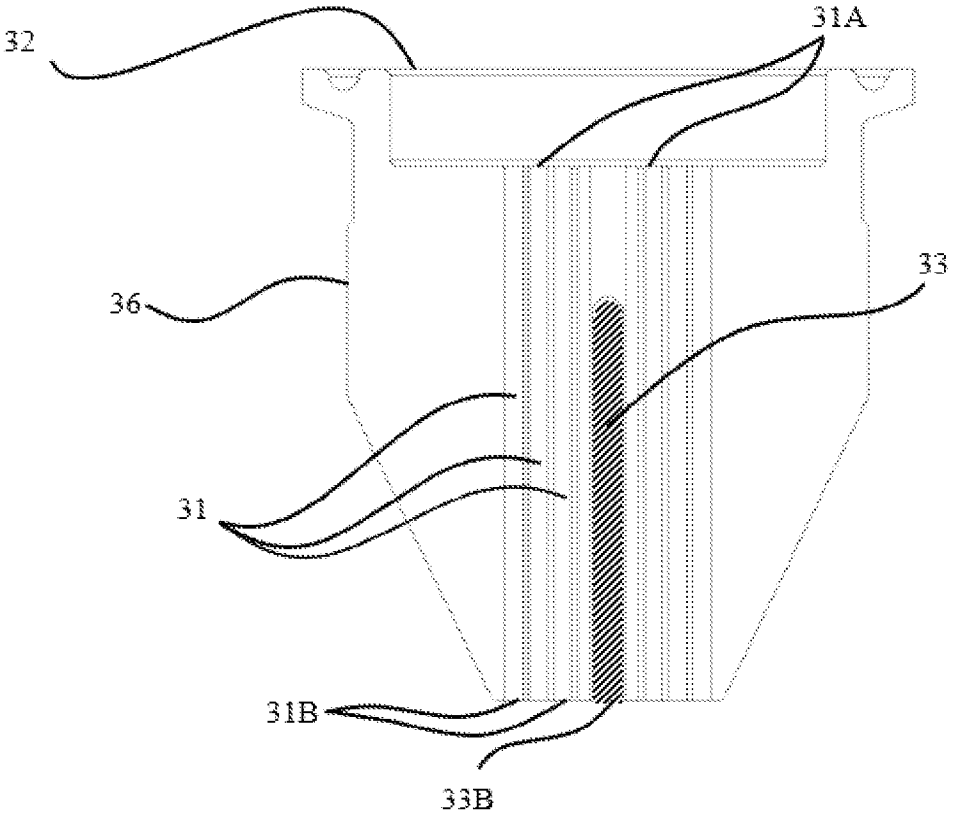

FIG. 3E is a cross-sectional view of the unitary co-injection nozzle of FIG. 1A along a plane that is perpendicular to III-III.

DETAILED DESCRIPTION OF THE INVENTION

Features and benefits of the various embodiments of the present invention will become apparent from the following description, which includes examples of specific embodiments intended to give a broad representation of the invention. Various modifications will be apparent to those skilled in the art from this description and from practice of the invention. The scope of the present invention is not intended to be limited to the particular forms disclosed and the invention covers all modifications, equivalents, and alternatives falling within the spirit and scope of the invention as defined by the claims.

As used herein, articles such as "a" and "an" when used in a claim, are understood to mean one or more of what is claimed or described. The terms "comprise," "comprises," "comprising," "contain," "contains," "containing," "include," "includes" and "including" are all meant to be non-limiting.

As used herein, the terms "substantially free of" or "substantially free from" means that the indicated space is present in the volume of from 0% to about 1%, preferably from 0% to about 0.5%, more preferably from 0% to about 0.1%, by total volume of the unitary dispensing nozzle.

The unitary co-injection nozzle of the present invention is made as an integral piece, without any moving parts (e.g., O-rings, sealing gaskets, bolts or screws). Such an integral structure renders it particularly suitable for high speed filling of viscous liquid, which typically requires high filling pressure. Such a unitary co-injection nozzle can be made by any suitable material with sufficient tensile strength, such as stainless steel, ceramic, polymer, and the like. Preferably, the co-injection nozzle of the present invention is made of stainless steel.

The unitary co-injection nozzle of the present invention may have an average height ranging from about 3 mm to about 200 mm, preferably from about 10 to about 100 mm, more preferably from about 15 mm to about 50 mm. It may have an average cross-sectional diameter ranging from about 5 mm to about 100 mm, preferably from about 10 mm to about 50 mm, more preferably from about 15 mm to about 25 mm.

Such co-injection nozzle provides two or more fluid passages for simultaneously or substantially simultaneously dispensing two or more liquids of different viscosity, solubility, and/or miscibility into a container. For example, one of the liquids can be a minor liquid feed composition, and the other can be a major liquid feed composition (i.e., the liquid making up the majority weight of the final liquid mixture). The container has an opening into which the two or more liquids are dispensed, while the total volume of the container may range from about 10 ml to about 10 L, preferably from about 20 ml to about 5 L, more preferably from about 50 ml to about 4 L.

To ensure sufficient mixing of such liquids in the container, it is necessary that at least one of these liquids, preferably the major feed liquid composition, is filled at a significantly high speed so as to generate a sufficiently strong influx and turbulence in the container. Preferably, the major feed liquid composition is filled at an average flow rate ranging from about 50 ml/second to about 10 L/second, preferably from about 100 ml/second to about 5 L/second, more preferably from about 500 ml/second to about 1.5 L/second. The minor feed liquid composition can be filled at an average flow rate ranging from 0.1 ml/second to about 1000 ml/second, preferably from about 0.5 ml/second to about 800 ml/second, more preferably from about 1 ml/second to about 500 ml/second.

FIGS. 1A-1F show a unitary co-injection nozzle, according to one embodiment of the present invention. Specifically, nozzle 10 has a first end 12 and a second, opposite end 14. Preferably but not necessarily, the first end 12 is on top, while the second, opposite end 14 is at the bottom. More preferably, the first and second ends 12 and 14 have relatively planar surfaces. One or more sidewalls 16 are located between the first and second ends 12 and 14. Such sidewalls can be either planar or cylindrical.

The nozzle 10 contains a plurality of first flow passages 11 for flowing a first fluid (e.g., a major liquid feed composition) therethrough. Each of the first flow passages 11 is defined by a first inlet 11A located at the first end 12 and a first outlet 11B located at the second end 14, as shown in FIG. 1E. Further, the nozzle 10 contains a second flow passage 13 for flowing a second fluid (e.g., a minor liquid feed composition) therethrough. The second flow passage 13 is defined by a second inlet 13A located near the sidewall 16 and a second outlet 13B located at the second end 14, so that the second flow passage 13 extends through the sidewall 16 and the second end 14, as shown in FIG. 1E.

The first and second outlets 11B and 13B can have any suitable shapes, e.g., circular, semicircular, oval, square, rectangular, crescent, and combinations thereof. Preferably but not necessarily, both the first and second outlets 11B and 13B are circular, as shown in FIG. 1C.

Figure 1C:
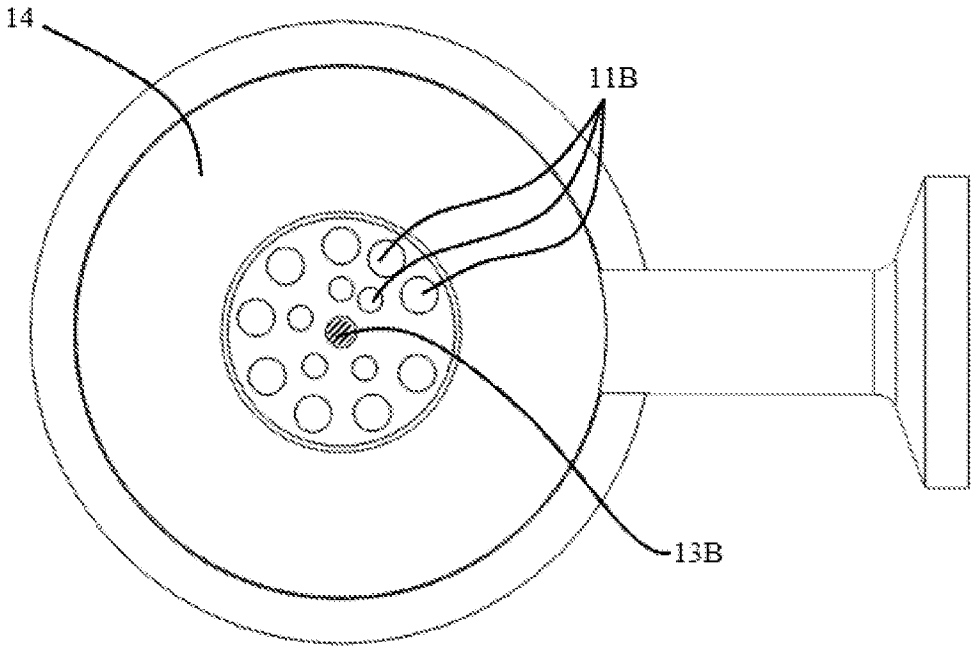
FIG. 1C is the bottom view of the unitary co-injection nozzle of FIG. 1A.
Figure 1D:
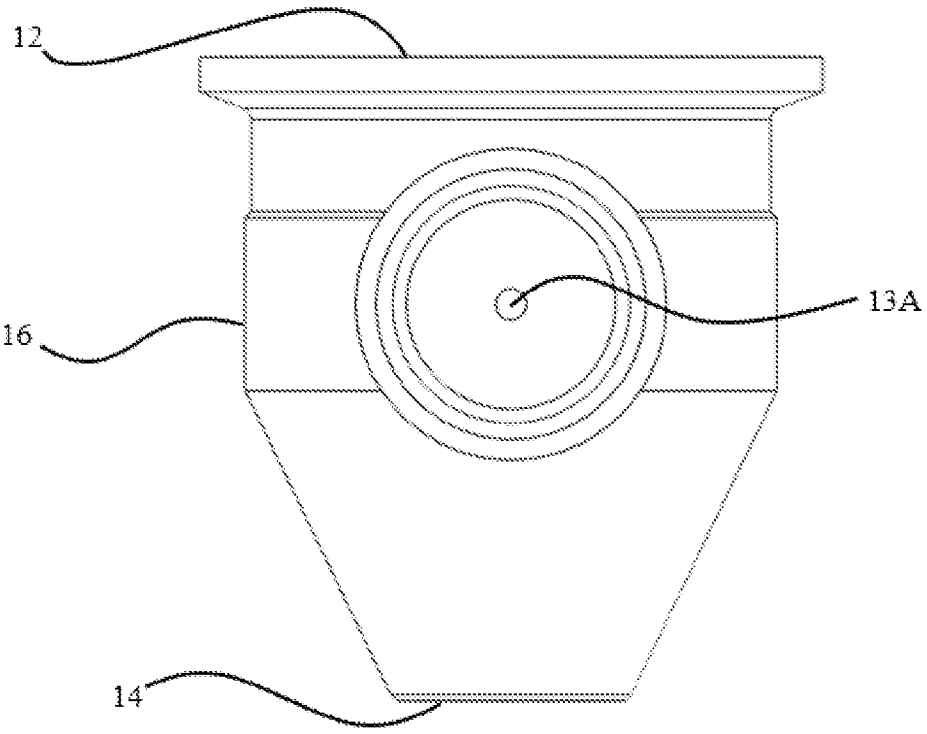
FIG. 1D is a side view of the unitary co-injection nozzle of FIG. 1A.
Figure 1E:
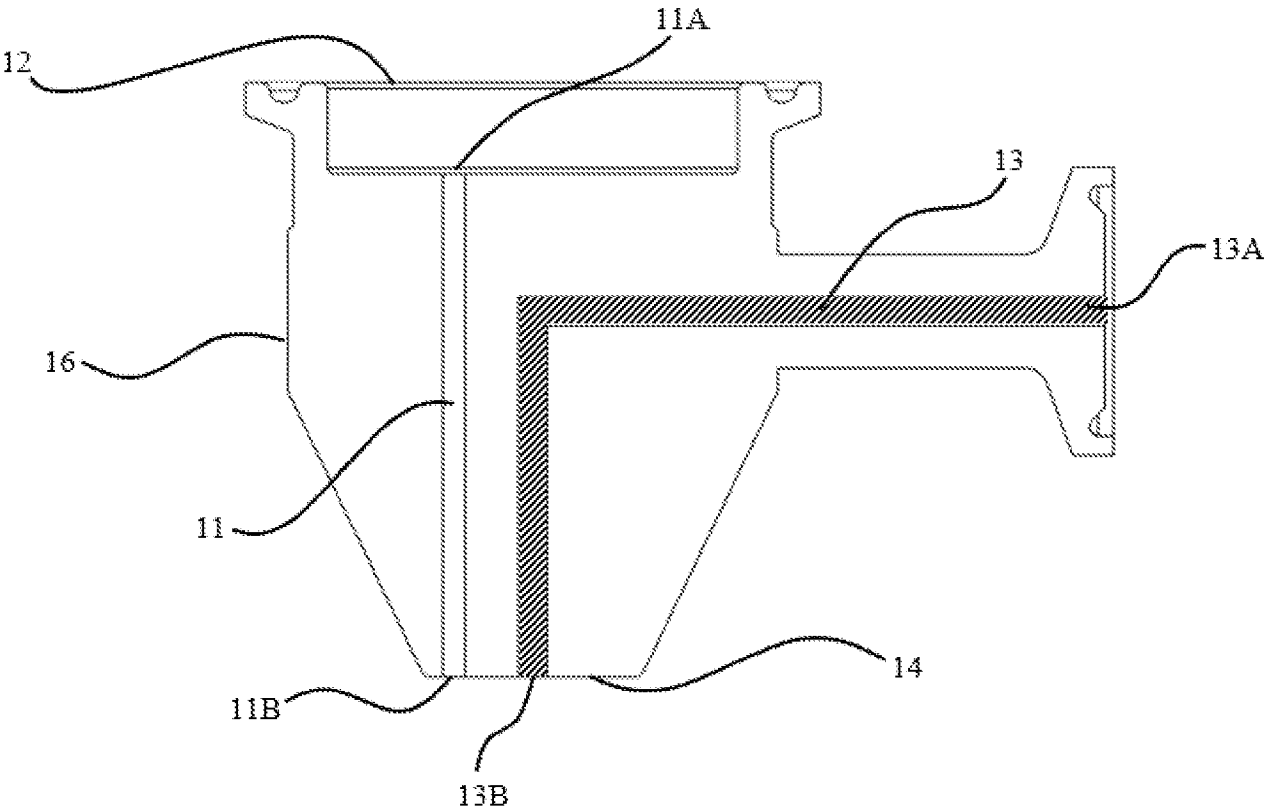
FIG. 1E is a cross-sectional view of the unitary co-injection nozzle of FIG. 1A along plane I-I.
Figure 1F:
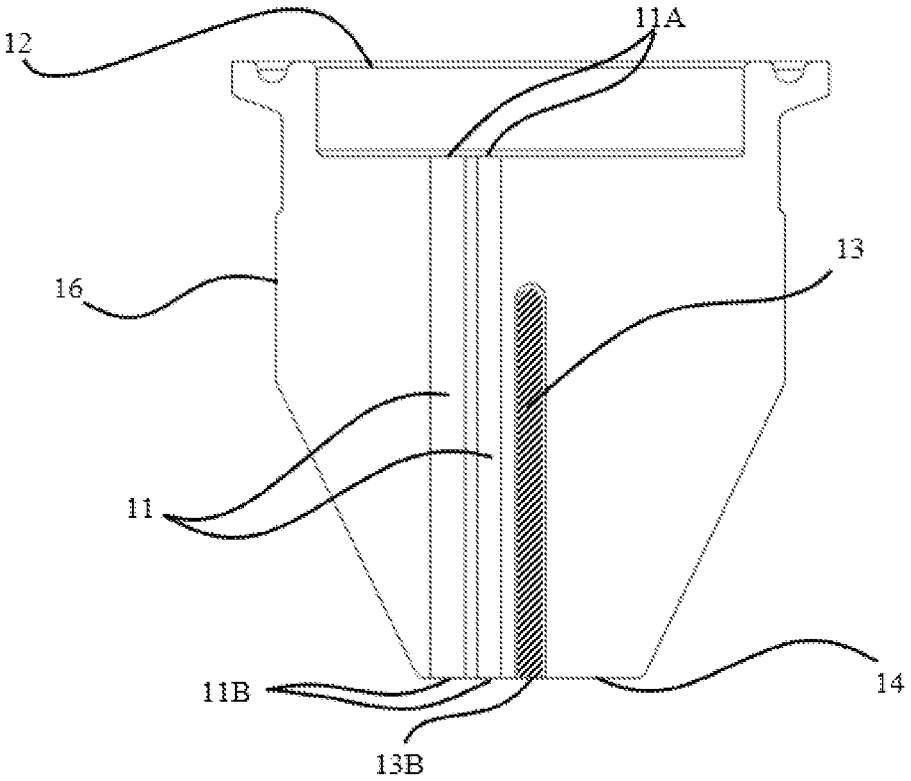

Further, the second outlet 13B is substantially surrounded by the plurality of first outlets 11B, as shown in FIG. 1C. In the event that the minor liquid feed composition is prone to form hard-to-remove residues once it is deposited on the container wall, such an arrangement is particularly effective for preventing the minor liquid feed composition from depositing on the container wall, because the minor feed flow existing the second outlet 13B will be substantially surrounded by a plurality of major feed flows existing the first outlets 11B, which form a "liquid shroud" around the minor feed flow and thereby reducing formation of hard-to-remove residues by the minor feed on the container wall.

The plurality of major feed flows can be configurated to form a diverging "liquid shroud" around the minor feed flow. Alternatively, the plurality of major feed flows may be substantially parallel to each other, thereby forming a parallel "liquid shroud" around the minor feed flow. Such a parallel arrangement of the major feed flows is particularly preferred in the present invention because it provides a greater local turbulence around the minor feed flow inside the container and enables a better, more homogenous mixing result.

Still further, the nozzle 10 is substantially free of any dead space (i.e., spaces that are not directly in the flow passages and therefore can trap liquid residues). Therefore, it is easy to clean and is less likely to cause cross-contamination when switching between different liquid feeds.

Preferably, but not necessarily, the ratio of the total cross-sectional area of the first outlets 11B over the total cross-sectional area of the second outlet 13B may range from about 5:1 to about 50:1, preferably from about 10:1 to about 40:1, and more preferably from about 15:1 to about 35:1. Such ratio ensures a significantly large major-to-minor flow rate ratio, which in turn enables more efficient dilution of the minor ingredient in the container, ensuring that there is no 'hot spots' of localized high concentrations of minor ingredient in the container.

FIGS. 2A-2E show a unitary co-injection nozzle, according to another embodiment of the present invention. Specifically, nozzle 20 has a first end 22 and a second, opposite end 24. Both the first and second ends 22 and 24 have relatively planar surfaces. A cylindrical sidewall 26 is located between the first and second ends 22 and 24.

The nozzle 20 contains a plurality of first flow passages 21 for flowing a first fluid (e.g., a major liquid feed composition) therethrough. Each of the first flow passages 21 is defined by a first inlet 21A located at the first end 22 and a first outlet 21B located at the second end 24, as shown in FIGS. 2B, 2C and 2E. Further, the nozzle 20 contains a second flow passage 23 for flowing a second fluid (e.g., a minor liquid feed composition) therethrough. The second flow passage 23 is defined by a second inlet 23A located near the cylindrical sidewall 26 and a second outlet 23B located at the second end 24, so that the second flow passage 23 extends through the cylindrical sidewall 26 and the second end 24, as shown in FIGS. 2C and 2D.

All of the first outlets 21B have a crescent shape, while such crescents are arranged in a concentric manner with substantially the same radius center. In contrast, the second outlet 23B is circular in shape. Further, the second outlet 23B is located at the radius center of the first outlets 21B and is substantially surrounded by the plurality of first outlets 21B, as shown in FIG. 2C. In the event that the minor liquid feed composition is prone to form hard-to-remove residues once it is deposited on the container wall, such an arrangement is particularly effective for preventing the minor liquid feed composition from depositing on the container wall, because the minor feed flow existing the second outlet 23B will be substantially surrounded by the plurality of major feed flows existing the first outlets 21B, which form a "liquid shroud" around the minor feed flow and thereby reducing formation of hard-to-remove residues by the minor feed on the container wall.

The nozzle 20 is also substantially free of any dead space and is therefore easy to clean with a reduced risk of cross-contamination when changing liquid feeds.

Preferably, but not necessarily, the ratio of the total cross-sectional area of the first outlets 21B over the total cross-sectional area of the second outlet 23B may range from about 5:1 to about 50:1, preferably from about 10:1 to about 40:1, and more preferably from about 15:1 to about 35:1.

FIGS. 3A-3D show a unitary co-injection nozzle, according to yet another embodiment of the present invention. Specifically, nozzle 30 has a first end 32 and a second, opposite end 34. Both the first and second ends 32 and 34 have relatively planar surfaces. A cylindrical sidewall 36 is located between the first and second ends 32 and 34.

The nozzle 30 contains a plurality of first flow passages 31 for flowing a first fluid (e.g., a major liquid feed composition) therethrough. Each of the first flow passages 31 is defined by a first inlet 31A located at the first end 32 and a first outlet 31B located at the second end 34, as shown in FIGS. 3B, 3C and 3E. Further, the nozzle 30 contains a second flow passage 33 for flowing a second fluid (e.g., a minor liquid feed composition) therethrough. The second flow passage 33 is defined by a second inlet 33A located near one side of the cylindrical sidewall 36 and a second outlet 33B located at the second end 34, so that the second flow passage 33 extends through the cylindrical sidewall 36 and the second end 34, as shown in FIGS. 3C and 3D. Still further, the nozzle 30 contains a third flow passage 35 for flowing a third fluid (e.g., an additional minor liquid feed composition) therethrough. The third flow passage 35 is defined by a third inlet 35A located near the other side of the cylindrical wall 36 and a third outlet 35B located at the second end 34, so that the third flow passage 35 extends through the cylindrical sidewall 36 (at an side opposite to the second flow passage 33) and the second end 34, as shown in FIGS. 3A, 3C and 3D.

All of the first outlets 31B have a crescent shape, while such crescents are arranged in a concentric manner with substantially the same radius center. In contrast, the second outlet 33B and the third outlet 35B circular in shape. Further, the second outlet 33B is located at the radius center of the first outlets 31B, while the third outlet 35B is located adjacent to the radius center of the first outlets 31B. In this manner, both the second and third outlets 33B and 35B are substantially surrounded by the plurality of first outlets 31B, as shown in FIG. 3C. In the event that either or both of the minor liquid feed compositions are prone to form hard-to-remove residues once deposited on the container wall, such an arrangement functions to minimize the deposition of minor liquid feed compositions onto the container wall, because the minor feed flows existing the second outlet 33B and the third outlet 35B will be substantially surrounded by the plurality of major feed flows existing the first outlets 31B, which form a "liquid shroud" around the minor feed flows and thereby reducing formation of hard-to-remove residues by the minor feeds on the container wall.

The nozzle 30 is also substantially free of any dead space and is therefore easy to clean with a reduced risk of cross-contamination when changing liquid feeds.

Preferably, but not necessarily, the ratio of the total cross-sectional area of the first outlets 31B over the total cross-sectional area of the second outlet 33B may range from about 5:1 to about 50:1, preferably from about 10:1 to about 40:1, and more preferably from about 15:1 to about 35:1. Similarly, the ratio of the total cross-sectional area of the first outlets 31B over the total cross-sectional area of the third outlet 35B may range from about 5:1 to about 50:1, preferably from about 10:1 to about 40:1, and more preferably from about 15:1 to about 35:1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A unitary dispensing nozzle for co-injecting two or more liquids, comprising:

(a) a first end;

(b) a second, opposite end;

(c) one or more sidewalls between said first and second ends;

(d) one or more first flow passages for flowing a first fluid through said nozzle, wherein each of said first flow passages is defined by a first inlet and a first outlet, wherein said first inlet(s) is/are located at the first end of said nozzle, and wherein said first outlet(s) is/are located at the second end of said nozzle;

(e) one or more second flow passages for flowing a second fluid through said nozzle, where said second fluid is different from said first fluid in viscosity, solubility, and/or miscibility, wherein each of said second flow passages is defined by a second inlet and a second outlet, wherein said second inlet(s) is/are located on or near at least one of said sidewalls and wherein said second outlet(s) is/are located at the second end of said nozzle, so that said one or more second flow passages extend through said at least one of the sidewalls and the second end of said nozzle; and (f) one or more third flow passages for flowing a third fluid through said nozzle, where said third fluid is different from said first and second fluids in viscosity, solubility, and/or miscibility, wherein each of said third flow passages is defined by a third inlet and a third outlet, wherein said third inlet(s) is/are located on or near at least one of said sidewalls and is/are spaced apart from said second inlet(s) and wherein said third outlet(s) is/are located at the second end of said nozzle, so that said one or more third flow passages extend through said at least one of the sidewalls and the second end of the nozzle, and wherein said third outlet(s) is/are substantially surrounded by said first outlet(s);

wherein said second outlet(s) is/are substantially surrounded by said first outlet(s), and wherein said unitary dispensing nozzle is an integral piece free of any movable parts and substantially free of dead space.

2. The unitary dispensing nozzle of claim 1, wherein said first outlet(s) is/are characterized by a shape that is selected from the group consisting of circular, semicircular, oval, square, rectangular, crescent, and combinations thereof.

3. The unitary dispensing nozzle of claim 1, comprising a plurality of said first flow passages with a plurality of said first inlets and a plurality of said first outlets, wherein each of said first outlets is characterized by a circular shape.

4. The unitary dispensing nozzle of claim 3, wherein said plurality of first flow passages are configured to form a plurality of first liquid flows that are substantially parallel to each other.

5. The unitary dispensing nozzle of claim 1, wherein each of said first outlet(s) is characterized by a crescent shape, with said second outlet(s) being located at or near the radius center of the crescent(s) formed by the first outlet(s).

6. The unitary dispensing nozzle according to claim 1, wherein the ratio of the total cross-sectional area of the first outlet(s) over the total cross-sectional area of the second outlet(s) ranges from 5:1 to 50:1.

7. The unitary dispensing nozzle according to claim 6, wherein the ratio of the total cross-sectional area of the first outlet(s) over the total cross-sectional area of the second outlet(s) ranges from 10:1 to 40:1.

8. The unitary dispensing nozzle according to claim 7, wherein the ratio of the total cross-sectional area of the first outlet(s) over the total cross-sectional area of the second outlet(s) ranges from 15:1 to 35:1.

9. The unitary dispensing nozzle according to claim 1, wherein the ratio of the total cross-sectional area of the first outlet(s) over the total cross-sectional area of the second outlet(s) ranges from 5:1 to 50:1.

10. The unitary dispensing nozzle of claim 1, wherein the ratio of the total cross-sectional area of the first outlet(s) over the total cross-sectional area of the third outlet(s) ranges from 5:1 to 50:1.

11. The unitary dispensing nozzle of claim 10, wherein the ratio of the total cross-sectional area of the first outlet(s) over the total cross-sectional area of the third outlet(s) ranges from 10:1 to 40:1.

12. The unitary dispensing nozzle of claim 11, wherein the ratio of the total cross-sectional area of the first outlet(s) over the total cross-sectional area of the third outlet(s) ranges from 15:1 to 35:1.

* * * * *